US009957679B2

(12) United States Patent
Lovell et al.

(10) Patent No.: US 9,957,679 B2
(45) Date of Patent: May 1, 2018

(54) REAR MOUNTED SNOW PLOW SYSTEM FOR AN AUTOMOBILE

(71) Applicants: John Lovell, Winnipeg (CA); Richard Hewett, Oak Bluff (CA)

(72) Inventors: John Lovell, Winnipeg (CA); Richard Hewett, Oak Bluff (CA)

(73) Assignee: John Lovell, Winnipeg, Manitoba ( * ) Notice: Subject to any disclaimer, the term of this patent is extended or adjusted under 35 U.S.C. 154(b) by 0 days. days.

(21) Appl. No.: 15/214,570

(22) Filed: Jul. 20, 2016

(65) Prior Publication Data

US 2017/0022677 A1 Jan. 26, 2017

Related U.S. Application Data

(60) Provisional application No. 62/194,628, filed on Jul. 20, 2015.

(51) Int. Cl.
*E04H 5/06* (2006.01)
*E01H 5/06* (2006.01)

(52) U.S. Cl.
CPC ..... *E01H 5/061* (2013.01); *E01H 5/068* (2013.01)

(58) Field of Classification Search
CPC ..... E01H 5/061–5/063; E01H 5/068; E02F 3/7622; E02F 3/7627
See application file for complete search history.

(56) References Cited

U.S. PATENT DOCUMENTS 4,403,432 A 9/1983 Biance
4,680,880 A * 7/1987 Boneta ..... E01H 5/06 172/812
4,754,562 A 7/1988 McGarrah et al.
5,524,368 A 6/1996 Struck et al.
6,151,809 A 11/2000 Altheide
6,240,658 B1 6/2001 Knutson et al.
6,408,548 B1 6/2002 Altheide
6,453,582 B1 9/2002 Fulton, III
6,594,924 B2 7/2003 Curtis
6,874,260 B2 4/2005 Mullett
7,661,210 B2 2/2010 Shepherd
(Continued)

FOREIGN PATENT DOCUMENTS

GB 558812 A * 1/1944 ..... E01H 5/067

*Primary Examiner* — Tara Mayo-Pinnock
(74) *Attorney, Agent, or Firm* — Kyle R Satterthwaite; Ryan W Depuis; Ade & Company Inc.

(57) ABSTRACT

A snow plow system for an automobile features a frame connectable to a hitch receiver, a blade movable by an electrically powered actuator between a lowered snow-clearing position a raised transport position, a power unit placed within a trunk space of the automobile, a power connection line between the power unit and the actuator, and a wireless remote operable from a passenger cabin of the automobile. The power connection line traverses through a gasket sealed space between the trunk lid and trunk walls, thereby powering the device without any modification to the automobile. A flexible member connected between the actuator and the blade is operable to raise and lower the blade in a controlled manner under operation of the actuator, while allowing the blade to momentarily trip over ground level obstructions during use. A biasing mechanism forces the blade back into the snow-clearing position once the obstruction is cleared.

10 Claims, 3 Drawing Sheets

(56) References Cited

U.S. PATENT DOCUMENTS

| | | | | |
|---|---|---|---|---|
| 7,703,222 | B2 | 4/2010 | Schmeichel | |
| 8,291,622 | B2 | 10/2012 | Gappy | |
| 2009/0119954 | A1* | 5/2009 | Lemieux | E01H 5/068 37/236 |
| 2016/0375839 | A1* | 12/2016 | Weihl | B60R 11/06 280/769 |

* cited by examiner

REAR MOUNTED SNOW PLOW SYSTEM FOR AN AUTOMOBILE

CROSS REFERENCE TO RELATED APPLICATIONS

This application claims benefit under 35 U.S.C. 119(e) of Provisional Application Ser. No. 62/194,628, filed Jul. 20, 2015.

FIELD OF THE INVENTION

The present invention relates generally to snow plow accessories for motor vehicles, and more particularly to a snow plow system with a raisable and lowerable blade removably mounted at the rear of an automobile for clearing driveways or other areas of snow by driving the vehicle forwardly with the blade pulled therebehind in the lowered position.

BACKGROUND

In the art of snow plows, it has been previously proposed to mount a raisable and lowerable plow blade at the rear of a motor vehicle in a position lying perpendicularly or obliquely transverse to the vehicle so that driving the vehicle forwardly will displace the snow forwardly, and sometimes also laterally depending on the selected angle of the blade. Accordingly, a home owner can clear their driveway by raising the blade up off the ground, backing the vehicle toward the garage other property-side terminus of the driveway, lowering the blade, and then driving forwardly toward the street-side terminus of the driveway in order to draw the snow forwardly with the vehicle toward the street, or to displace the snow laterally outward to the sides of the driveway. Use of one such plow in this manner is disclosed in U.S. Pat. No. 4,403,432 of Biance.

Examples of other rear-mounted snow plows can be found in U.S. Pat. Nos. 4,754,562; 6,151,809; 6,408,548, 6,453, 582, 6,874,260, 7,661,210, and 8,291,622. Other examples of vehicle mounted snow plow accessories can be found in U.S. Pat. Nos. 5,524,368, 6,240,658, 6,594,924, and 7,703, 222.

Despite the volume of prior art in this field, there remains room for improvement, and Applicant has developed a unique snow plow system with advantageous features neither shown nor suggested by the forgoing prior art.

SUMMARY OF THE INVENTION

According to a first aspect of the invention, there is provided a snow plow system for an automobile comprising:

a frame including a tongue arranged at a front end of the frame for sliding coupling with a hitch receiver of the automobile;

a blade movably coupled to the frame for raising and lowering of the blade relative to the frame between a snow-clearing position in contact with an underlying ground surface beneath the blade and a raised transport position elevated above said ground surface;

an electrically powered actuator operable to move the blade between the snow-clearing and raised transport positions;

a power unit for placement within a trunk space of the automobile;

a power connection line connected or connectable between said power unit and said electrically powered actuator; and a wireless remote operable to control the electrically powered actuator from within a passenger cabin of the automobile.

According to a second aspect of the invention, there is provided a snow plow system for an automobile comprising:

a frame including a tongue arranged at a front end of the frame for sliding coupling with a hitch receiver of the automobile;

a blade movably coupled to the frame for raising and lowering of the blade relative to the frame between a snow-clearing position in contact with an underlying ground surface beneath the blade and a raised transport position elevated above said ground surface;

an electrically powered actuator operable to move the blade between the snow-clearing and raised transport positions;

a power unit for placement within the automobile; and a power connection line connected or connectable to said power unit, wherein said power connection line is dimensioned to traverse between a trunk space of said automobile and an external environment outside the automobile through a gasket sealed space between a trunk lid of the automobile and trunk walls of said automobile;

whereby the power unit is protected within the trunk space of the automobile, while no modification to the automobile is required to install the frame and provide power to actuator.

According to a third aspect of the invention, there is provided a snow plow system, for an automobile comprising:

a frame having opposing front and rear ends spaced apart in a first direction that lies longitudinally of the automobile in an installed state thereon, the front end of the frame being configured for attachment to a rear end of the automobile to support the frame in said installed state;

a blade having a length dimension oriented in a second direction that lies transversely to the first direction so that the blade lies transversely of the automobile in the installed state of the frame;

a pivotal connection between the frame and the blade that allows raising and lowering of the blade about a pivot axis that lies transversely to the first direction;

an actuator operable in a lifting direction to raise the blade about the pivot axis, and operable in a lowering direction to lower the blade about the pivot axis;

a biasing mechanism arranged to bias the blade downwardly about the pivot axis into a snow-clearing position in contact with an underlying ground surface beneath the blade; and a flexible member having a tensionable and relaxable connection between the actuator and the blade, by which operation of the actuator in the lifting and lowering directions with the flexible member in a tensioned state raises and lowers the blade, respectively, and by which tripping of the blade upwardly and forwardly over an obstruction on said ground surface is enabled by an automatically induced relaxation of the flexible member as said blade rides upwardly over said obstruction before the biasing mechanism forces the blade back down once the obstruction is cleared.

Preferably a power unit is provided for placement within a trunk space of the vehicle and a power connection line connected or connectable to said power unit, wherein the actuator is an electrically powered actuator powered by said power unit through said power connection line, and said power connection line is dimensioned to traverse between said trunk space and an external environment outside the automobile through a gasket sealed space between a trunk lid of the automobile and trunk walls of said automobile.

Preferably there is provided a wireless remote operable from inside a passenger cabin of the automobile to control the actuator and thereby move the blade between the snow-clearing and raised transport positions.

Preferably the flexible member comprises a chain.

Preferably the biasing mechanism resides in front of the blade.

Preferably the pivotal connection resides in front of the blade.

Preferably an entirety of the frame resides in front of the blade.

Preferably the actuator comprises a linear actuator.

Preferably the actuator comprises an electrically powered linear actuator.

Preferably there is provided a bracket standing upright from a top edge of the blade, and the flexible member connects to the bracket at a height spaced above the top edge of the blade.

Preferably the frame is a bifurcated frame having two arms on which respective pivot points of the pivotal connection are defined at symmetric distances outward from a lengthwise mid-point of the blade.

Preferably the flexible member connects to the blade at a plane residing mid-way between the two arms of the bifurcated frame.

Preferably the arms of the bifurcated frame are joined by a cross-member that spans between the arms at a position located forwardly of the pivotal connection, and the cross-member is pivotally connected to a front section of the frame that extends forwardly from the cross-member to connect to the automobile, the cross-member being pivotal relative to the front section about an upright articulation axis to change an angle at which the blade transverses the first direction.

Preferably the front frame section comprises a tongue and a pair of plates mounted respectively atop and beneath the tongue at a rear end thereof, the articulation axis being defined by a pivot pin to which the cross-member is attached between said pair of plates, and the plates comprise multiple lock pin holes that are each positioned to align with a corresponding lock pin hole in the cross-member in a respective angular position of the blade in order to receive a lock pin for locking the cross-member in said respective angular position.

Preferably the actuator is mounted on a tongue of the frame that is arranged for sliding coupling with a hitch receiver of the automobile.

Preferably the frame comprises a tongue that is arranged for sliding coupling with a hitch receiver, and a tongue adapter sleeve having a hollow interior that is sized and shaped to be slidable over said tongue to increase an effective cross-sectional size thereof at the front end of the frame to adapt the tongue for mating with a larger hitch receiver.

Preferably the blade is also pivotal about an upright articulation axis to change an angle at which the blade resides relative to the first direction, the articulation axis is defined by a pivot pin connected between a front section of the frame for connecting to the automobile and a rear section of the frame that is connected to the blade by the pivotal connection, the front section comprises a pair of plates at a rear end of the front frame, the rear frame spans transversely across the front frame from one side thereof to another between the pair of plates, and the plates comprise multiple lock pin holes that are each positioned to align with a corresponding lock pin hole in the rear frame section in order to receive a lock pin for locking the cross-member in said respective angular position.

Preferably the pivotal connection comprises a channel-shaped outer member attached to one of either the blade or the frame and having an open-sided channel, and an inner member pivotally pinned to the channel-shaped member through opposing closed sides of the channel, an open side of the open-sided channel accommodating pivotal movement of the inner member into an out of a stop position that blocks further movement of the blade about the pivot axis by contact between the inner member and a third closed side of the channel.

Preferably the biasing mechanism comprises a torsion spring that closes around the pivot axis in the open-sided channel of the channel-shaped member and is at least partially concealed by the inner channel member.

Preferably the biasing mechanism comprises a torsion spring closing around the pivot axis.

BRIEF DESCRIPTION OF THE DRAWINGS

One embodiment of the invention will now be described in conjunction with the accompanying drawing in which.

DETAILED DESCRIPTION

Figure 1:
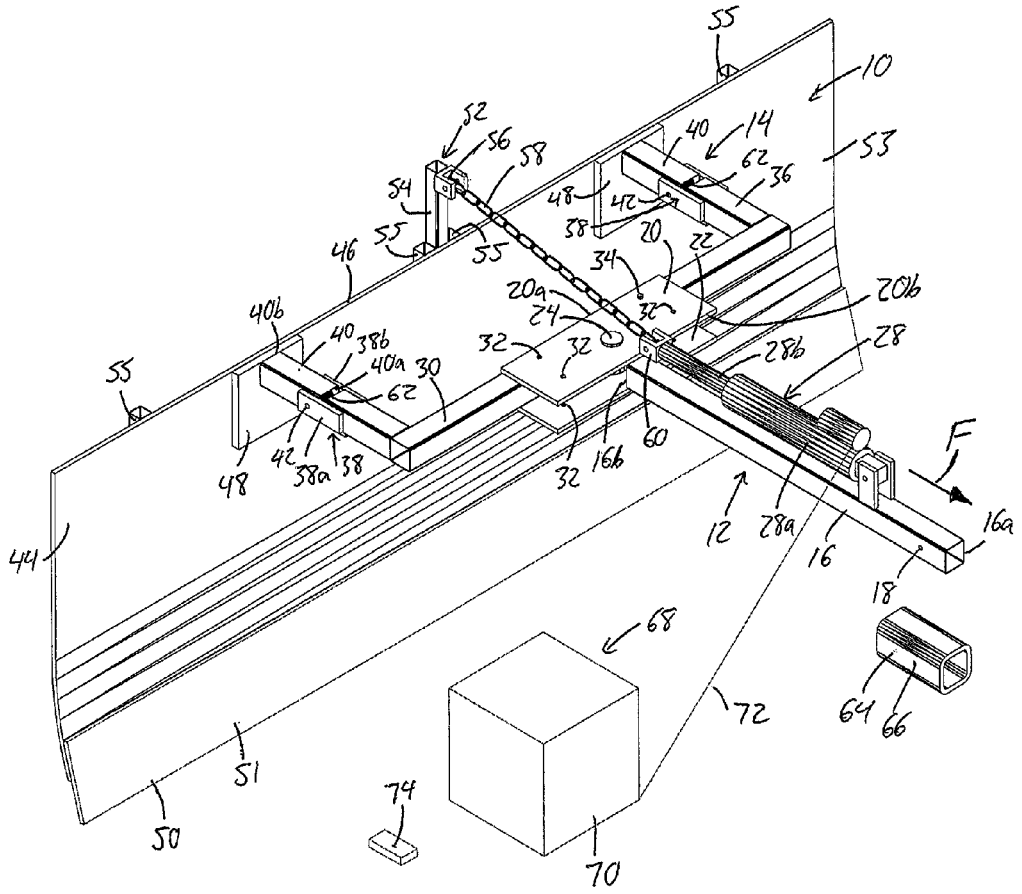
FIG. 1 is a perspective view of a rear-mount snow plow attachment together with a schematically illustrated power unit and remote control for same.

The rear-mount snow plow attachment of FIG. 1 features a singular plow blade 10 attached to a hitch-carried frame 12 by a pivotal connection 14. The frame 12 features an elongated tongue 16 in the form of a straight length of rectangular metal tubing of suitable size for sliding receipt of the tongue's front end 16*a* in a conventional hitch receiver of an automobile, where alignment of a horizontally transverse through-hole 18 in the tongue 16 with a corresponding horizontally transverse through-hole in the receiver enables pinned connection between the tongue and receiver to lock the frame in a stable position extending longitudinally rearward of the vehicle at the rear and thereof. Such pinned connection of a vehicle accessory to a receiver hitch of an automobile using aligned transverse holes in the accessory tongue and hitch receiver is well known in the art, and thus not described or illustrated in further detail herein.

At the opposing rear end 16*b* of the tongue 16, the frame 12 features a pair of horizontally oriented plates 20, 22 respectively mounted atop and beneath the tongue 16, for example by welded attachment thereto. A vertical pivot pin 24 passes through the two plates 20, 22 at a position lying on the central longitudinal axis of the tongue 16, and is rotatable relative to the tongue 16 and attached plates 20,22 about the vertically upright central axis of the pin 24. The tongue 16 and attached plates 20, 22 form a front section of the frame that is pivotally coupled to a rear section of the frame to allow articulation between the two frame sections about the central axis of the vertical pivot pin 24.

With continued reference to the front frame section, a pair of mounting lugs 26 stand vertically upright from the topside of the tongue 26 at an intermediate location along the tongue's length, and more specifically an intermediate location situated between the rear end 16*b* of the tongue and the transverse through-hole 18 by which the tongue is lockable to the hitch receiver. The lugs 26 reside closer to the tongue's front end 16*a* than rear end 16*b*. An electrically powered linear actuator 28 has one end of its housing 28*a* pivotally coupled to the mounting lugs 26 to allow pivoting of the actuator 28 about a horizontal axis lying perpendicular to the longitudinal axis of the tongue 16. The lugs 26 therefore mount the actuator 28 atop the tongue 16 in a position lying longitudinally thereof in a central vertical plane containing the tongue's longitudinal axis. The displaceable output member 28*b* of the linear actuator 28 reaches rearwardly from the housing 28*a* in the central vertical plane of the tongue toward the two horizontal plates 20, 22 at the rear end of the front frame section.

The rear frame section features a horizontal cross-member 30 in the form of a respective linear length of rectangular tubing that lies transversely of the tongue 16. The cross-member 30 lies between the two plates 20, 22 of the front frame section in the same horizontal plane as the tongue 16, and is affixed to the vertical pivot pin 24, for example by welding. Accordingly, the cross-member 30 and the remainder of the rear frame section can articulate relative to the front frame section by pivoting about the upright axis of the vertical pivot pin 24. Such articulation allows the rear frame section to be set as a selected angle relative to the front frame section, thereby determining the angle at which the blade resides during use.

For the purpose of locking the rear frame section in a selected position about its articulation pivot pin 24, the upper and lower plates 20, 22 of the front frame section features multiple sets of vertical through-holes 32. Each set features a hole in the upper plate, and a matching hole aligned therewith in the lower plate. Two rear sets of holes reside near a rear edge 20*a* of the upper plate 20 at positions symmetrically disposed across the central vertical plane of the frame. Each of these rear sets aligns with a respective vertical through hole in the cross-member 30 when the cross-member is in a position lying perpendicular to the tongue 16. FIG. 1 shows a locking pin 34 received in one of these rear sets of holes in order to lock the cross-member 30 in the perpendicular position. Two front sets of holes reside nearer to a front edge 20*b* of the upper plate 20, and are again disposed symmetrically across the central vertical plane from one another.

In the illustrated embodiment, each set of holes in the plates 20, 22 of the front frame section is situated at the same radial distance from the upright axis of the vertical pivot pin 24, which is equal to the radial distance from the upright axis of the vertical pivot pin 24 to each of the two vertical through-holes in the cross-member 30 of the rear frame section. If the locking pin 34 is removed, the cross-member can be pivoted about the upright axis of the vertical pivot pin 24 from the illustrated perpendicular position to a position oriented obliquely to the tongue's longitudinal axis so as to align one of the front sets of holes in the front frame plates 20, 22 with one of the two through-holes in the cross-member, whereupon insertion of the locking pin 34 into these aligned holes will now lock the cross-member in this new obliquely-oriented position.

As an alternative to having the radial position of the two plate hole sets on each side of the central plane equal to the radial position of a singular through-hole on the matching half of the cross-member, the plate hole sets on each side of the central plane may have different radial distances to the upright axis of the vertical pivot pin, provided that a different respective through-hole at is provided in the respective half of the cross-member for each set of plate holes at the same radial distance from the upright axis of the vertical pivot pin that matches the respective set of plate holes. The functional result is the same, in that the locking pin 34 can be inserted when alignment is achieved between a hole in the cross-member and a selected set of holes in the frame plates. It will be appreciated that the radial distances to the cross-member hole(s) and plate holes on one side of the central vertical plane need not match those found on the other side thereof.

The inclusion of two rear plate hole sets in the illustrated embodiment enables a user to lock the cross-member in the perpendicular position by inserting the lock pin 34 from either side of the snow plow attachment, but it will be appreciated that other embodiments could feature only a singular set of plate holes that align with a respective cross-member hole in the perpendicular position. While the inclusion of plate holes in both plates allows passage of the lock pin 34 fully through both plates, for example to allow a cotter-pin or the like to be passed through the pin 34 near the lower end thereof opposite the pin's head in order to better secure the lock pin 34 in place, it will be appreciated that if a detent pin or other self-locking fastener was instead used as the lock pin, a cotter pin or other separate means for securing the lock pin could be omitted, thereby avoiding the need for matching holes in the two plates, or even the need for the corresponding hole in the cross-member to pass fully therethrough. Accordingly, other embodiments could optionally feature a single plate, but the use of two plates provides better support to the vertical pivot pin 24 and attached cross-member 30.

The rear frame section features a pair of arms 36 in the form of short linear lengths of the rectangular metal tubing that reach rearwardly from the cross-member 30 at opposing ends thereof at perpendicular angles thereto. The overall frame therefore has a bifurcated shape, with the cross-member 30 branching out to opposite sides of the tongue 16 where the arms 36 continue rearwardly toward the blade 10. The pivotal connection between the frame 12 and the blade 10 features two pivot points, one at each arm 36 of the bifurcated frame 12. At each arm 36, a respective pivot assembly features a channel-shaped 38 member affixed to the arm 36 with three closed-sides of its channel embracing about the arm 36 from the underside thereof, and with the fourth open side of its channel facing upward. The pivot assembly is completed by an inner member 40 that has a proximal end 40*a* received within the channel-shaped member, and a horizontal pivot pin 42 that passes through the opposing vertical sides 38*a*, 38*b* of the channel-shaped member 38 and the portion of the inner member 40 received therebetween. Accordingly, the inner member 40 is pivotally coupled to the respective channel-shaped member 38 for pivotal motion relative thereto about the central axis of the horizontal pivot pin 42. Each inner member is a short linear length of rectangular metal tubing, the distal end 40*b* of which is affixed to a front face 44 of the blade near a top edge 46 thereof, for example via a flat mounting plate 48 welded to the blade's front face and to the distal end of the pivot assembly's inner member 40.

The proximal end 40*a* of the inner member 40 of each pivot assembly is pivotally coupled to the respective channel-shaped outer member 42 that embraces about the undersides of the arm 36 and inner member 40. FIG. 1 shows each inner member 40 in a lowered stop position resting atop the closed bottom side of the respective channel-shaped member 38, which defines a fully-lowered position of the blade beyond which further lowering the blade 10 is blocked by this contact between the underside of each inner member 40 and the closed bottom of the respective channel-shaped member 38. The open topside of the channel-shaped member 38 allows the distal end 40*b* of the respective inner member 40 to pivot upward about the central axis of the respective horizontal pivot pin 42, which is aligned with the pivot pin of the other pivot assembly so that they share the same common axis. The blade 10 is thereby pivotally supported for lifting and lowering of the blade about this axis between the lowered snow-clearing position of FIG. 1, which places a lower edge 50 of the blade 10 on the ground, and a raised transport position elevated off the ground.

The blade 10 lies parallel to the cross-member 30, and is carried thereon by the arms 36 and the two pivot assemblies. A length of the blade 10 thus lies transversely to the longitudinal axis of the tongue 16, and the particular angle of the blade in relation to the longitudinal axis of the tongue is determined by the angular position at which the cross-member 30 is currently locked in relation to the articulating connection between the front and rear frame sections. Accordingly, the blade has at least three possible angular positions, i.e. the perpendicular position shown, and at least one obliquely oriented position in each direction about the upright axis of the vertical pivot pin 24.

A connection bracket 52 is affixed to the rear side of the blade and stands vertically upright from the top edge 46 thereof at the mid-point of the blade's length so as to reside at the central vertical plane of the plow attachment when the blade is in the perpendicular position. The illustrated bracket features a main upright 54 in the form of a linear length of rectangular metal tubing that stands vertically upright from the blade 10, and a connector 56 in the form of a piece of channel affixed to the front side of the main upright 54 with the open side of the channel facing forward to create two forwardly projecting lugs.

The lower edge 50 of the blade may be formed by a strip 51 of rubber or other resilient material attached to a lower extent of a metal plate 53 that makes up a substantial majority of the blade. The blade may feature one or more reinforcement struts or bars 55 affixed to the backside of the metal plate 53, as shown in FIG. 1. Simple formation of the blade solely by the metal plate and metal reinforcement struts running up the rear face of the blade helps keep the weight of the attachment down compared to more complicated blade structures. The illustrated embodiment features four reinforcement struts 55 in the form of metal tubing of smaller cross-sectional size than the frame and pivot assembly components, and for example of the same size as the upright bracket's main upright 54. Two of the reinforcement bars are situated proximate the opposite ends of the blade, with the other two being situated in abutment with, or close proximity to, opposite sides of the upright bracket 54.

A flexible member 58 is connected between the bracket 52 and the displaceable output member 28*b* of the linear actuator 28. The flexible member 58 of the illustrated embodiment is formed by a length of flexible metal chain, but other embodiments may employ a rope, cable, or strap of any number of possible materials. The free end of the displaceable output member 28*b* of the actuator features a connector 60 for attachment of the flexible member 58 thereto. As shown, the connector 60 may be provided in the same channel form as the lug-defining connector 56 of the upright bracket 54, but with the open side of the channel facing rearwardly toward the blade 10. Each end of the flexible member is fastened or affixed to the a respective one of the connectors 56, 60, for example by pinned connection through the lugs thereof. The flexible member forms a tensionable and relaxable flexible connection between the actuator 28 and the blade 10 for the purpose of lifting and lowering the blade, and for allowing the blade to rise upward and 'trip' over any ground obstacles that may be presented as the blade 10 is pulled forwardly by driving of the vehicle in the forward direction F, as described in more detail below.

Figure 3:
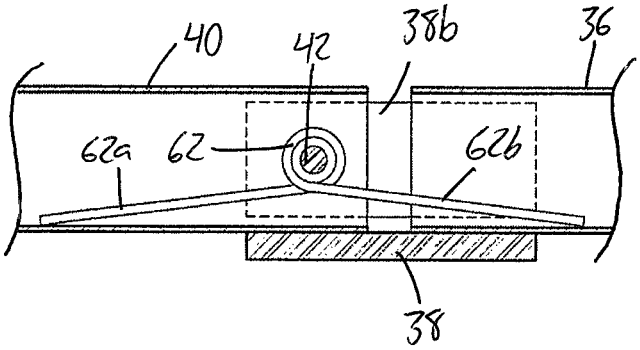
FIG. 3 is a close up cross-sectional view of the encircled area of FIG. 2, showing a spring loaded connection between a blade and frame of the attachment.

To ensure prompt return of the blade 10 downwardly toward the fully lowered position after the blade has tripped over the obstacle, a pair of helical torsion springs 62 respectively cooperate with the pivot assemblies of the pivotal connection 14 to form a biasing mechanism for urging the blade 10 downwardly about the horizontal pivot axis of the pivotal connection 14. Each torsion spring coils around the horizontal pivot pin 42 of a respective one of the two pivot assemblies in a position sheltered beneath the topside of the inner member 40 thereof and between the closed sides 38*a*, 38*b* of the pivot assembly's outer channel-shaped member 38. As shown in FIG. 3, the two legs 62*a*, 62*b* of the coil spring act against the closed bottoms of the tubular inner member 38 of the pivot assembly and the respective arm 36 of the rear frame section to continuously urge the distal end 40*b* of the inner member 40 downwardly toward the fully lowered stop position of the blade 10.

Operation of the linear actuator in a lifting direction withdrawing the displaceable output member 28*b* forwardly into the housing 28*a* pulls the flexible member 58 forwardly, which, due to the resistance provided by the weight of the blade and the spring force of the torsion springs, removes any existing slack in the flexible member to achieve a tensioned state thereof. With the flexible member tensioned, the pulling strength of the actuator 28 is sufficient to overcome the blade weight and spring force so that continued pulling of the tensioned flexible member 58 in the forward lifting direction raises the blade 10 upwardly off the ground about the horizontal pivot axis of the pivotal connection 14 between the frame and the blade. When lowering of the blade is desired, the linear actuator 28 is extended to displace the output member 28*b* rearward, during which the blade weight and spring force keep the flexible member tensioned. This tensioned state of the flexible member lowers the blade in a controlled manner, as opposed to allowing gravity and the spring force to slam the blade down with notable force, which that may damage the blade or underlying ground surface, e.g. a concrete driveway.

When the blade is tripped, i.e. rises upwardly under impact of its lower edge against a ground obstruction, this releases any tension that may be present in the flexible member in the spring-biased fully-lowered position of the blade, and thereby introduces slack in the chain. The blade rises up over the obstruction against the downward spring force exerted by the blade biasing mechanism, which promptly urges the blade back into toward the fully lowered state once the obstruction is cleared by sufficient forward displacement of the blade by the moving vehicle. The use of the flexible member in the connection between the actuator and the blade thus allows trip mechanism to make use of direct spring-loading of the sole pivotal connection 14 between the frame and the blade, thereby avoiding more complicated frame and linkage designs in prior art snow plow attachments where the trip springs are situated elsewhere and relative movement between different pivotally coupled frame sections is required to accommodate the tripping of the blade. The reduced complexity of the present design allows the overall attachment to be produced in a more material efficient manner reducing the weight of the apparatus, and thus improving the ease of installation.

The lightweight design allows the attachment to be used on any conventional, light duty, non-commercial passenger vehicles (e.g. sedans, coupes, hatchbacks, station wagons, SUVs, crossovers, etc.), so long as they are equipped with a receiver-style hitch. Accordingly, special use of large trucks is not required, and even a small compact car with a hitch can be used for snow-clearing purposes. The forgoing design also allows easy installation that, at least in some cases, can be performed even by senior citizens or others with mobility or health limitations, risks or complications, as the light-weight design allows the attachment to be easily lifted up to hitch level, whereupon a single pinned connection is all that is required to secure the attachment in its installed position.

To enable use of the snow plow attachment with different hitch sizes, an adapter sleeve 64 is provided in the form of a short linear length of rectangular tubing that has a hollow interior of the same shape but greater cross-sectional size than the tongue 16, whereby the sleeve 64 can be slid over the front end 16*a* of the tongue 16 to increase the effective cross-sectional size thereof for a suitable fit within a larger hitch receiver. The sleeve features a horizontally transverse through-hole 66 therein that aligns with that of the tongue 16 when fit thereover to enable locking of the tongue 16 to the larger size hitch receiver with a suitable locking pin.

To power the linear actuator 28, a power unit 68 features an environmentally sealed container or housing 70 in which a rechargeable battery pack is stored, along with a charging circuit by which the battery pack can be recharged by one, or preferably both, of 12-volt DC power and 110V AC mains power. For such recharging purposes, a suitable charging cable coupled to a charging port provided on the exterior of the power unit's housing. A power connection line 72, for example in the form of a two-wire cable, is has a relatively small outer diameter, or a minimal flat-cable thickness, which is less than a maximum amount of compression that a trunk closure gasket of a typical automobile can accommodate before becoming effectively rigid. To explain further, a typical automobile will feature a gasket that is compressed between the lid of the trunk and the perimeter walls of the trunk when the trunk lid is closed down over the trunk opening that is delimited by the trunk's perimeter walls. The thinness of the power connection line 72 is such that, with the power unit placed in the trunk of the vehicle, the power connection line 72 can be laid over the rear perimeter wall of the trunk so as to pass from the interior trunk space to the external environment surrounding vehicle, and closure of the trunk lid will simply result in the trunk gasket closely conforming around the power connection line without pinching the power connection line and without interfering with full closure of the trunk lid in a substantially or fully sealed manner.

As a result, the power unit is stored in a secure, sheltered state inside the trunk of the vehicle, but no drilling or other wire-routing modification of the vehicle is required. The dedicated power unit avoids the need to tap into the existing electrical wiring of the vehicle. The user simply places the battery pack in the trunk, and routes the power line through the existing trunk opening before closing the trunk lid. The battery pack can optionally be removed from the vehicle for charging, for example to prevent depletion of the vehicle battery due to operation of the vehicle's existing trunk lights, which may be wired so as to stay on so long as the trunk is open. However, like the power connection cable used to connect the power unit to the actuator, the charging cable may be configured for routing through the gasket-sealed space of the trunk closure. As used herein, the term "trunk" is used to generally describe a rear cargo area of a vehicle that is opened and closed by a liftable lid that forms a weather-tight seal with cooperating perimeter edges of an access opening to this cargo, and accordingly encompasses the rear hatch of a hatchback or liftback vehicle.

Figure 2:
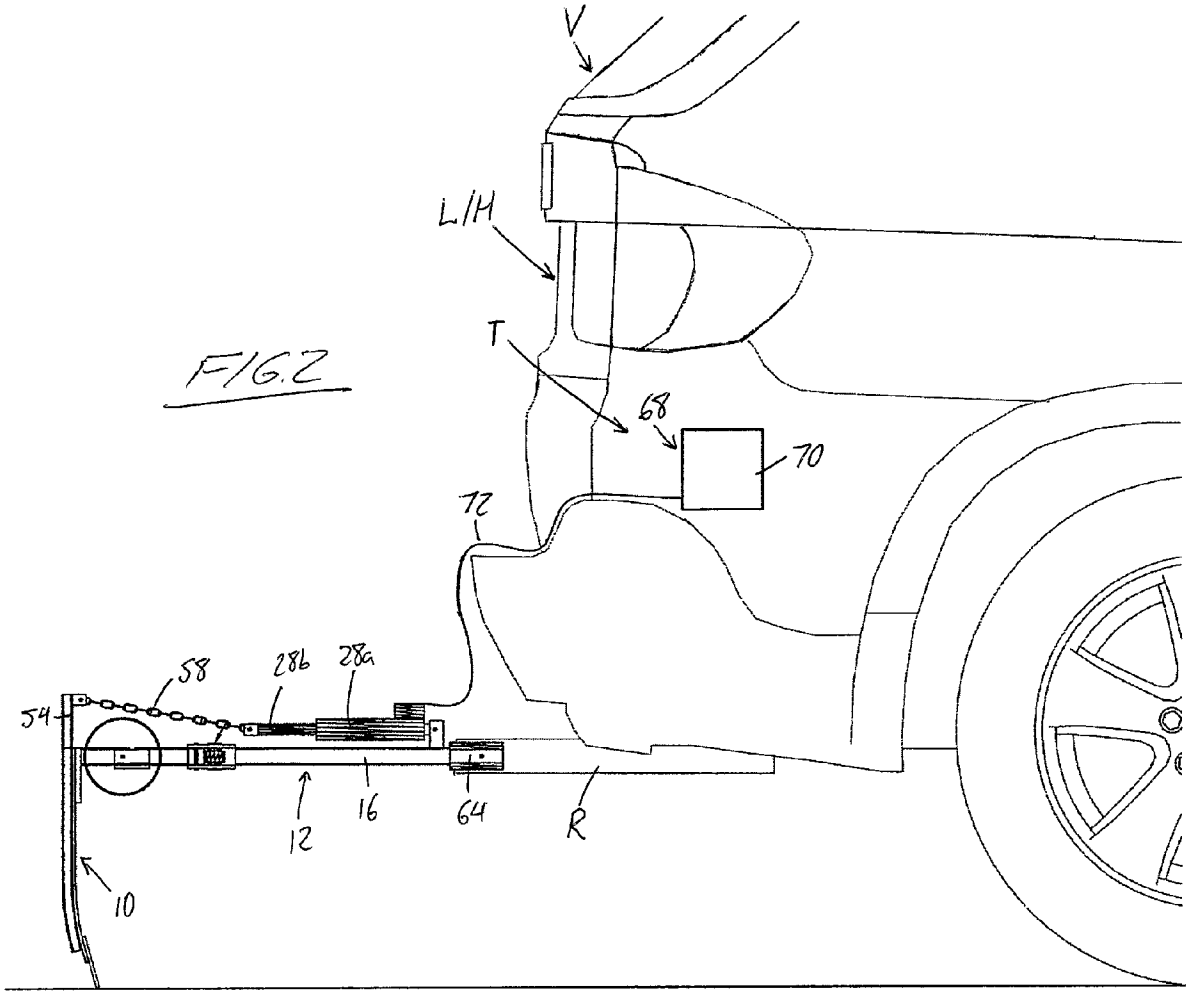
FIG. 2 is a side view of the rear-mount snow plow attachment of FIG. 1 installed on a passenger vehicle.

FIG. 2 shows the installed state of the snow-plow attachment, with the frame connected to the hitch receiver R of a conventional passenger vehicle V, and with the flexible power connection line 72 running up over the rear bumper B of the vehicle into the trunk space T through the gasket sealed gap between the trunk lid or hatch L/H and the perimeter walls of the trunk space.

Finally, a wireless remote control 74, for example in the form of a keychain fob, is provided for wireless remote control of the actuator 28 in both the lifting and lowering directions from inside the passenger cabin of the vehicle. The use of a wireless remote again avoids the need for any modification to the vehicle, for example for the purpose of routing suitable signal wire that would be required for a wired control. The wireless remote and dedicated battery pack make the product suitable for installation by the general consumer, as zero modification to the vehicle is required, and therefore no specialized knowledge is required to achieve full installation of the overall system. Full installation is achieved simply by connection of the attachment to the rear of the vehicle with a standard pinned connection to the vehicle's hitch receiver, placement of the battery pack in the trunk, connection of the power line between the power unit and the actuator, and placement of the remote control in the passenger/operator cabin of the vehicle. In vehicles where the operator/passenger cabin of the vehicle is open to the trunk area, the power unit may be placed within the operator/passenger cabin, with the power connection line extending rearwardly from the operator/passenger cabin and onward through the cargo space of the trunk to exit the gasketed area between the trunk lid and trunk walls. For example, may vehicles feature fold-down rear seats that would enable such routing of the power connection line by a general consumer without requiring modification to the vehicle or installation by a specialized or trained technician.

The use of an electrical actuator keeps the number of components and the complexity of installation to a minimum, and ensures compatibility with the largest variety of hitch-equipped vehicles, as opposed to use of pneumatic or hydraulic actuators which require a source of compressed air or pressurized fluid, and therefore would be limited to use only on specialized vehicles already having such equipment, or would require modification of a conventional passenger vehicle or incorporation of such equipment into the attachment, thereby increasing the weight, complexity and cost of same. In addition, use of a dedicated power unit and an electrically powered actuator increases electrical efficiency in operation of the, as it avoids losses in using the vehicle's hydrocarbon fuel energy to electrical, pneumatic or hydraulic energy.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. In combination, an automobile having an enclosed trunk space accessible by an openable/closable trunk lid, and a snow plow system for said automobile comprising:

a frame including a tongue situated at a front end of the frame and received in a hitch receiver of the automobile to carry the frame in a hitch-supported position reaching longitudinally rearward from the automobile;

a blade movably coupled to the frame for raising and lowering of the blade relative to the frame between a snow-clearing position in contact with an underlying ground surface beneath the blade and a raised transport position elevated above said ground surface;

an electrically powered non-hydraulic actuator operable to move the blade between the snow-clearing and raised transport positions;

a dedicated power unit supported separately and independently of the frame within the trunk space of the automobile, said power unit lacking any connection to electrical wiring of the automobile and comprising a rechargeable battery pack, a charging port and a charging circuit configured for recharging of said battery pack from an AC mains power source via said charging port;

a power connection line connected from said power unit to said electrically powered non-hydraulic actuator and routed through a sealed gasket space between the openable/closeable trunk lid of the automobile and perimeter walls of the trunk space; and a wireless remote operable to control the electrically powered non-hydraulic actuator from within a passenger cabin of the automobile;

whereby the power unit is protected within the trunk space of the automobile, while the vehicle is entirely unmodified by the frame's hitch supported position and the power unit's lack of connection to the electrical wiring of the automobile.

2. The combination of claim 1 wherein the system further comprises a charging cable connected or connectable to the charging port and configured for connection with an AC mains power source to charge s d battery pack via said charging port.

3. The combination of claim 1 wherein said power connection line is connected directly to the electrically powered non-hydraulic actuator.

4. The combination of claim 1 wherein said electrically powered actuator lies longitudinally of the frame in a rearward reaching direction.

5. The combination of claim 4 comprising a flexible member having one end connected directly to a linearly displaceable output member of the electrically powered non-hydraulic actuator and another end connected to the blade for lifting and lowering thereof by the flexible member under operation of the electrically powered non-hydraulic actuator.

6. In combination, an automobile having an enclosed trunk space accessible by an openable/closable bunk lid, and a snow plow system for an automobile comprising:

a frame including a tongue arranged at a front end of the frame for sliding coupling with a hitch receiver of the automobile;

a blade movably coupled to the frame for raising and lowering of the blade relative to the frame between a snow-clearing position in contact with an underlying ground surface beneath the blade and a raised transport position elevated above said ground surface;

an electrically powered non-hydraulic actuator operable to move the blade between the snow-clearing and raised transport positions;

a dedicated power unit supported separately and independently of the frame for placement within the trunk space of the automobile, said power unit lacking any connection to electrical wiring of the automobile and comprising a rechargeable battery pack, a charging port and a charging circuit configured for recharging of said battery pack from an AC mains power source via said charging port; and a power connection line connected or connectable to said power unit and said electrically powered non-hydraulic actuator, wherein said power connection line is dimensioned to traverse between the trunk space of said automobile and an external environment outside the automobile through a gasket sealed space between a trunk lid of the automobile and trunk walls of said automobile;

whereby the power unit is protected within the trunk space of the automobile, while no modification to the automobile is required to install the frame and provide power to the electrically powered non-hydraulic actuator.

7. The system of claim 6 further comprising a charging cable connected or connectable to the charging port and configured for connection with an AC mains power source to chare said battery pack via said charging port.

8. The system of claim 6 wherein said power connection line is connected directly to the electrically powered non-hydraulic actuator.

9. The system of claim 6 wherein said electrically powered non-hydraulic actuator lies longitudinally of the frame in a rearward reaching direction.

10. The system of claim 9 comprising a flexible member having one end connected directly to a linearly displaceable output member of the electrically powered non-hydraulic actuator and another end connected to the blade for lifting and lowering thereof by the flexible member under operation of the electrically powered non-hydraulic actuator.

* * * * *